US007077066B2

(12) United States Patent
Blohberger et al.

(10) Patent No.: US 7,077,066 B2
(45) Date of Patent: Jul. 18, 2006

(54) AXLE GUIDE

(75) Inventors: Erich Blohberger, Nauheim (DE); Oliver Franke, Seeheim-Jugenheim (DE); Helmut Schürmann, Maxdorf (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 10/433,298

(22) PCT Filed: Dec. 1, 2001

(86) PCT No.: PCT/EP01/14059

§ 371 (c)(1),
(2), (4) Date: Jan. 6, 2004

(87) PCT Pub. No.: WO02/46018

PCT Pub. Date: Jun. 13, 2002

(65) Prior Publication Data

US 2004/0099177 A1 May 27, 2004

(30) Foreign Application Priority Data

Dec. 5, 2000 (DE) ..... 100 60 408

(51) Int. Cl.
*B61F 5/00* (2006.01)

(52) U.S. Cl. ..... 105/218.2; 105/224.05

(58) Field of Classification Search ..... 105/218.1, 105/218.2, 222, 224.05, 224.1; 267/47, 36.1, 267/52, 158, 149, 148
See application file for complete search history.

(56) References Cited

U.S. PATENT DOCUMENTS

| | | | | |
|---|---|---|---|---|
| 3,445,911 | A * | 5/1969 | Stamm | 29/896.91 |
| 4,575,057 | A * | 3/1986 | Robertson | 267/47 |
| 4,688,778 | A * | 8/1987 | Woltron | 267/148 |
| 5,087,503 | A * | 2/1992 | Meatto | 428/162 |
| 6,811,169 | B1 * | 11/2004 | Schroeder et al. | 280/124.171 |

FOREIGN PATENT DOCUMENTS

JP 53-69313 * 6/1978

* cited by examiner

*Primary Examiner*—Mark T. Le
(74) *Attorney, Agent, or Firm*—Howrey LLP; David Owen; Koos Rasser

(57) ABSTRACT

The invention relates to an axle guide consisting of a fiber-synthetic material composite for guiding an axle in the running gear of a rail vehicle, in particular a high-speed rail vehicle. Said guide has two end sections (11, 11') for connecting the guide (1) both to the axle and to the chassis (2) of the running gear in a manner resistant to torsion and a central section (12) located therebetween, which has a longitudinal axis (13) aligned with the direction of travel (X) and across-section that is at least partially flat in the vertical direction (Z). The guide (1) has at least one integrated flexural joint (14) with a vertical flexural axis (15) and enables a rotational degree of freedom, which protects the wheel beating from damaging flexural stresses, to be achieved simply without the need for an additional joint component. The inventive guide also benefits from all the advantages of the glass fiber-synthetic material composite, such as adjustable rigidity that can be reproduced with narrow tolerances and that is defined almost independently of the temperature, resistance to wear, electric insulation, excellent material damping properties and favourable behaviour if a malfunction occurs.

18 Claims, 2 Drawing Sheets

AXLE GUIDE

BACKGROUND OF THE INVENTION

1. Field of the Invention

The invention relates to an axle guide, and more particularly, to an axle guide comprising a fiber-synthetic material composite for guiding an wheelset in the running gear of a rail vehicle.

2. Description of the Related Art

High-speed rail traffic places particularly stringent demands on the running gears of rail vehicles. The components of wheelset guidance in high-speed trains are subjected to particularly high loads. They have to ensure safe travel of the rail vehicle, day in day out, over several years, experiencing little wear in operation while at the same time requiring little maintenance. The linking of the wheelsets to the running gear chassis is decisive as far as safety and comfort are concerned. The wheelset guides in the running gear of rail vehicles serve the purpose of linking the axles to the running gear chassis, both in the direction of travel and transversely to it. In this context, the dynamics of the train require wheelset guide rigidities within a narrow tolerance band. The vertical rigidity of a wheelset guide should be very slight, so as to have as little influence as possible on primary springing. Thus, vertical rigidity is to be attuned with regard to its spring rate. Precisely and permanently meeting the required specified transverse rigidity is of prime importance for the desired dynamic characteristics of the train to remain within narrow boundaries. For high-speed travel, longitudinal rigidity must be as high as possible. Nevertheless, low-wear operation makes a certain compliance in the longitudinal direction desirable, so that in curved sections of the track the wheelsets can better adapt to the different radii of the two curved rails, thus reducing frictional wear on the wheels. To avoid current-induced damage to the wheelset rolling bearings, it is desirable for the wheelset guides to comprise a material which is not electrically conductive, or for the wheelset guides to be held to the wheelset in a non-conductive manner. For reasons of comfort, they should also have good damping properties so as to largely prevent the transmission of structure-borne noise from the wheelset to the running gear, and thus to the vehicle body.

From EP 0 363 573 A2, a wheelset guide with a fiber composite component for the bogie of a rail vehicle is known, which forte purpose of guiding the wheelset axles is leaf-spring-shaped. In order to transmit transverse moments, the wheelset guide is attached at end sections so as to be form locked and force locked, both to the wheelset bearing housing and to the bogie frame. The central section of the fiber composite component, extending along a horizontal longitudinal axis of the component, is of constant cross section which is flat in the vertical direction, in the manner of a leaf spring. In this way, the fiber composite component of the wheelset guide provides flexural elasticity in the vertical direction, while being highly rigid both transversely and longitudinally. This known wheelset guide has no rotational de-gree of freedom between the wheelset guide and the bearing housing, and, consequently, the wheel bearing housing is subjected to an undesirable flexural stress which in particular in the case of high-speed rail vehicles is very considerable.

BRIEF SUMMARY OF THE INVENTION

It is thus the object of the invention to create a wheelset guide of the type mentioned in the introduction which provides for a rotational degree of freedom between the wheelset guide and the housing of the wheel bearing.

According to the invention, this object is met by a wheelset guide which preferably in its central section, comprises at least one integrated flexural joint with vertical flexural axis. Depending on the requirements, two or several flexural joints, spaced apart from each other and comprising vertical flexural axes, may be provided. Preferably, the wheelset guide according to the invention comprises only one such flexural joint. In ibis way, a rotational degree of freedom between the wheelset guide and the wheel bearing housing is achieved without the need to attach an additional joint of differential design. Depending on the requirements, the flexural joint can be located in any position along the longitudinal extension of the wheelset guide. The design of the wheelset guide according to the invention as a single-piece fiber-synthetic material composite component makes it possible to set the rigidities of the wheelset guide in a targeted way via the geometry. In this way, connection of the wheelsets to the running gear frame can be established with a rigidity that can be reproduced within narrow tolerances, and that is almost independent of the temperature. This in turn makes it possible to increase the speed of travel while providing a high degree of safety and little wheel wear. The wheelset guide can be designed such that for the duration of the useful life of the rail vehicle it can be considered to be serviceable, and in contrast to wheelset guides whose rotational degree of freedom is achieved by means of a rubber bush, said wheelset guide is resistant to wear, without the need for continual maintenance or even replacement at regular intervals. By using a glass fiber synthetic material composite, desirable electrical insulation is achieved to prevent current-related damage to the rolling bearings of the wheelsets. When compared to steel, fiber-synthetic material composite has significantly better material damping properties. Consequently, the wheelset guide according to the invention to a very large extent prevents structure-borne noise from the wheelset to the running gear, and thus to the body; in this way increasing passenger comfort.

In a preferred embodiment of the invention, in particular the central section of the wheelset guide comprises a sub-section whose cross-section tapers off towards the flexural joint. In this way, the effect of flexibility in the vertical direction is enhanced. Tapering-off of the cross-section may take place along the longitudinal axis of the wheelset guide, corresponding to the distribution of the bending moment, by a gradual narrowing of the horizontal width. In addition or as an alternative, it is also possible to gradually reduce the vertical thickness of the cross-section in the direction towards the flexural joint.

In an advantageous embodiment of the invention, the flexural joint is arranged between two sub-sections with cross-sections which taper off in opposite directions. In this embodiment, the flexural joint is preferably placed in the middle of the wheelset guide. In this configuration, the axle guide is symmetrically deformed in an advantageous way, both during vertical load transmission in a S-shape and during horizontal transverse load in a V-shape.

In a preferred embodiment of the invention, the flexural joint is a horizontal throat in the cross-section of the wheelset guide. By way of this throat in the cross-section of the wheelset guide, a region of increased flexibility around a vertical axis and thus a flexural joint with vertical flexural axis is integrated in the wheelset guide in a particularly simple way.

In a particularly preferred embodiment of the invention, the cross-section of the wheelset guide, in the region of the flexural joint, is at least partly flat in horizontal transverse direction. In this way, an additional cross-sectional area which extends in vertical direction can be added to the cross-section of the horizontally throated flexural joint so as to reduce the danger of buckling in the region of the joint when transmitting longitudinal forces.

Preferably, a glass fiber synthetic material composite with fibers predominantly extending in the direction of the longitudinal axis of the wheelset guide is provided as a material for the wheelset guide. This material, for example with E-glass fibers, is particularly suit-able because it provides very high fatigue resistance at low rigidity. The different require-ments for rigidity in various spatial directions are met by way of aligning the direction of the fibers.

In an advantageous embodiment of the invention, the central section of the wheelset guide comprises shearing-action bearing layers with fibers crossing each other, in a horizon-tal plane, at an angle of ±5° to ±60° in relation to the longitudinal axis. In such a case it is favourable to place the flexural joint in the middle of the wheelset guide and design the size of the cross-section so that it is adequate to prevent stability failure as a result of buckling. Consequently, the wheelset guide can also take very considerable pressure forces which act in longitudinal direction.

In a further advantageous embodiment of the invention, the end sections of the wheelset guide predominantly comprise fibers which extend unidirectionally in the direction of the longitudinal axis, while the central section predominantly comprises fibers crossing each other, in a vertical plane, at an angle of ±5° to ±60° in relation to the longitudinal axis. This measure also strengthens the central section of the wheelset guide so that it shows im-proved vertical flexural rigidity.

Preferably, the vertical flexural rigidity of the wheelset guide is higher in the region of the flexural joint than it is in other axle guide regions. In this way, the flexural joint may be designed with a correspondingly reduced cross-section, i.e. it may for example have a more pronounced throat in the horizontal transverse direction.

In a further particularly preferred embodiment of the invention, at least one closed torsion tube made of fiber layers with fibers intersecting at an angle of ±5° to ±60° in rela-tion to the longitudinal axis is arranged in the core of the wheelset guide. In addition, outside the core, the wheelset guide comprises fibers which predominantly extend in the direction of the longitudinal axis. The inclusion of a tube in the cross-section of the axle guide not only improves the transverse and longitudinal rigidity but also the torsional stiffness around the longitudinal axis of the wheelset guide, thus improving the loading capacity and the integrity of the wheelset guide overall.

In a further particularly preferred embodiment of the invention, the core of the axle guide comprises high-strength R-glass fibers or S-glass fibers or high-strength or highly-rigid carbon fibers right through from one end section to the other end section. With E-glass fibers preferably used otherwise, this measure particularly strengthens the cross-section of the wheelset guide by replacing the glass fibers with high-strength or highly rigid fibers particularly against longitudinal tensile forces or pressure forces.

In another preferred embodiment of the invention, the end sections comprise wedge-shaped thickened sections. In this way, the introduction of force against the wheelset guide being pulled out from the clamping arrangement on the side of the frame or of the bearing is additionally supported by form locking. According to an alternative embodiment of the invention, the end sections comprise fixing lugs. For example, a double lug connection is eminently suitable for taking lateral forces for moment-resistant attachment of the wheelset guide to the wheelset and to the running gear frame.

BRIEF DESCRIPTION OF THE DRAWINGS

Below, further advantageous embodiments of the invention are described by means of an embodiment, shown in the drawing, of a wheelset guide according to the invention. The following are shown.

DESCRIPTION OF PREFERRED EMBODIMENTS

Figure 1:
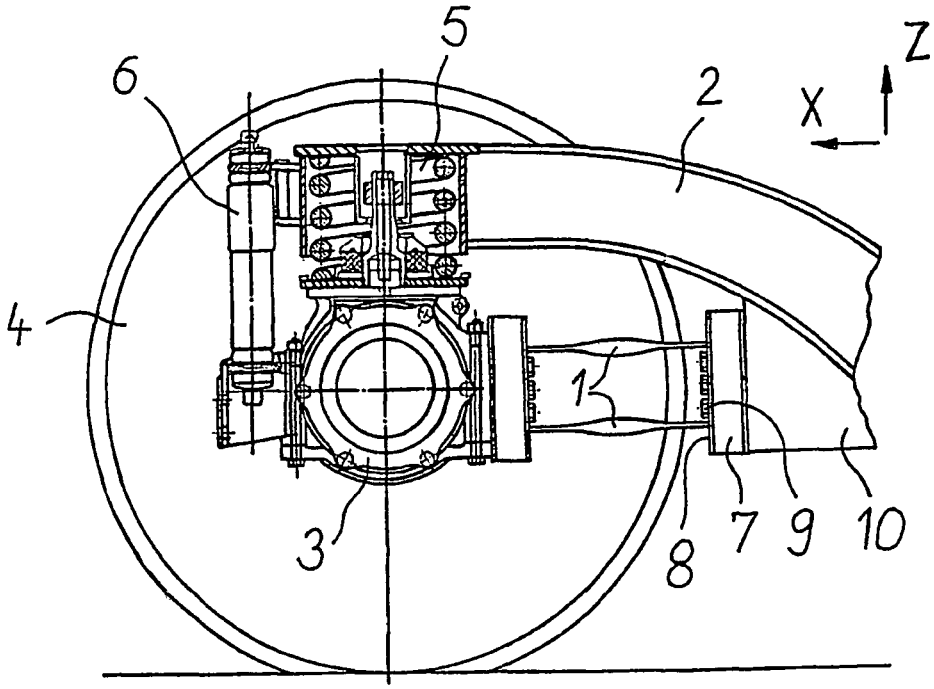
FIG. 1 a wheelset guide according to the invention, in its installation environment.

According to FIG. 1, for the purpose of guiding a wheelset, each side of the running gear or bogie of a rail vehicle, said running gear or bogie comprises two wheelset guides 1, arranged in parallel with one on top of the other, and with said wheelset guides 1 being connected both to the frame 2 of the running gear and to the housing 3 of the wheel bearing. The axles of the wheels 4 of the wheelset are held in the wheel bearings, which are rolling bearings. The frame 2 is supported on the wheelset by way of a primary spring 5, which is a helical spring. An oscillation damper 6 is arranged parallel to the primary spring 5, both together characterising the vertical spring movement of the frame 2 relative to the wheelset of the rail vehicle. Parallel arrangement of the wheelset guides 1 provides the advantage that additional flexural stress of the primary spring 5 is avoided. The wheelset guides are clamped at the ends so as to be resistant to torsion. The tension forces are applied by way of straining rings 7 made of fiber composite material, and acting on the ends of the two wheelset guides 1 arranged one on top of the other. By means of threaded connections 9, the wheelset guides 1 are clamped via steel blocks 8, which are arranged in the middle between said wheelset guides 1, to the housing 3 of the wheel bearing, and, by way of a bracket 10, to the frame 2 of the running gear. During parallelly guided lowering of one of the two wheelset guide clamp-ing arrangements, an S-shaped deformation of the entire wheelset guide 1 results. The longitudinal axis of the wheelset guides 1 is aligned approximately in the direction of travel X. Except for the section right in the middle, the cross-section is flat in the vertical direction Z, because the wheelset guide 1 should be as flexible as possible in the direction of the spring deflection of the carriage.

Figure 2:
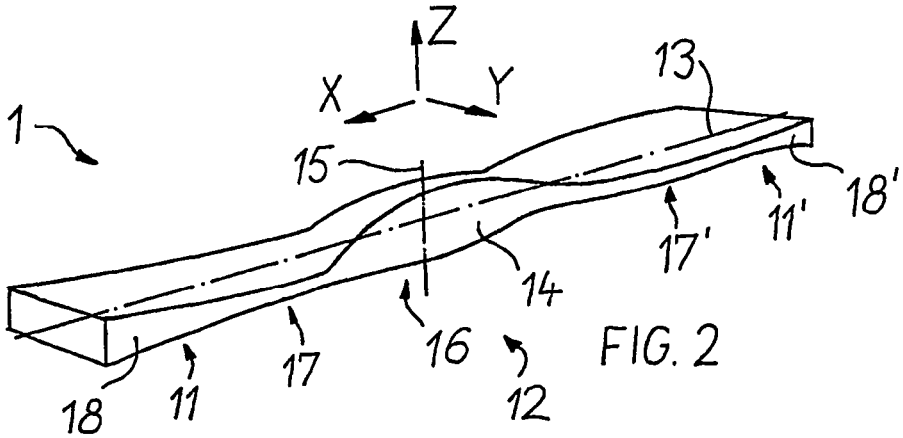
FIG. 2 a perspective view of an embodiment of a wheelset guide according to the invention.

According to FIG. 2, the axle guide 1 comprises two end regions 11 and 11' for connection to the wheelset and the frame 2 of the running gear, as well as a central section 12, arranged in-between. A flexural joint 14 comprising a flexural axis 15 which extends in the vertical direction Z is arranged in the central section 12 with respect to the longitudinal axis 13 of the wheelset guide 1, with said longitudinal axis 13 being aligned parallel to the direction of travel X. The flexural joint 14 comprises a horizontal throat 16 with a cross-section which is flattened in the horizontal transverse direction Y. This provides for the flexibility which is required around the flexural axis 15, in the region of the flexural joint 14, while at the same time providing for a cross-section extending in the X-Z plane, of adequate size to provide very good longitudinal rigidity of the wheelset guide 1. On both sides of the flexural joint 14, in the longitudinal direction 13, sub sections 17 and 17' follow, wherein the cross-section of the wheelset guide 1 tapers off towards the direction of the flexural joint 14. This tapering-off of the cross section is achieved by a component thickness which is reduced both in the Z-direction and in the Y-direction, said reduction corresponding to the flexural moments encountered during operation. The end sections 11 and 11' comprise wedge-shaped thickened sections 18 and 18', so that torsion-resistant clamping of the axle guide 1 is not only achieved by a frictional connection due to the straining ring, but also by a form locking connection.

Figure 3:
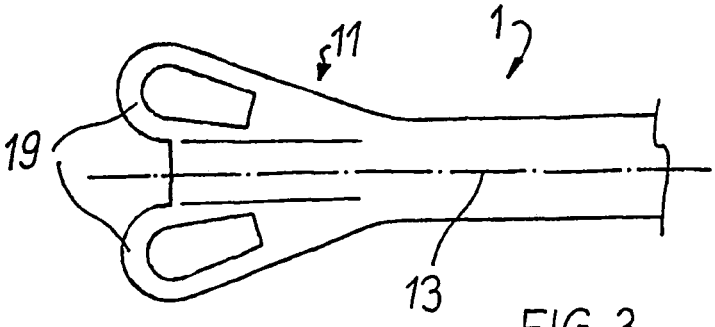
FIG. 3 an end section of a wheelset guide according to the invention, of an embodiment different from that shown in FIG. 2.
Figure 4:
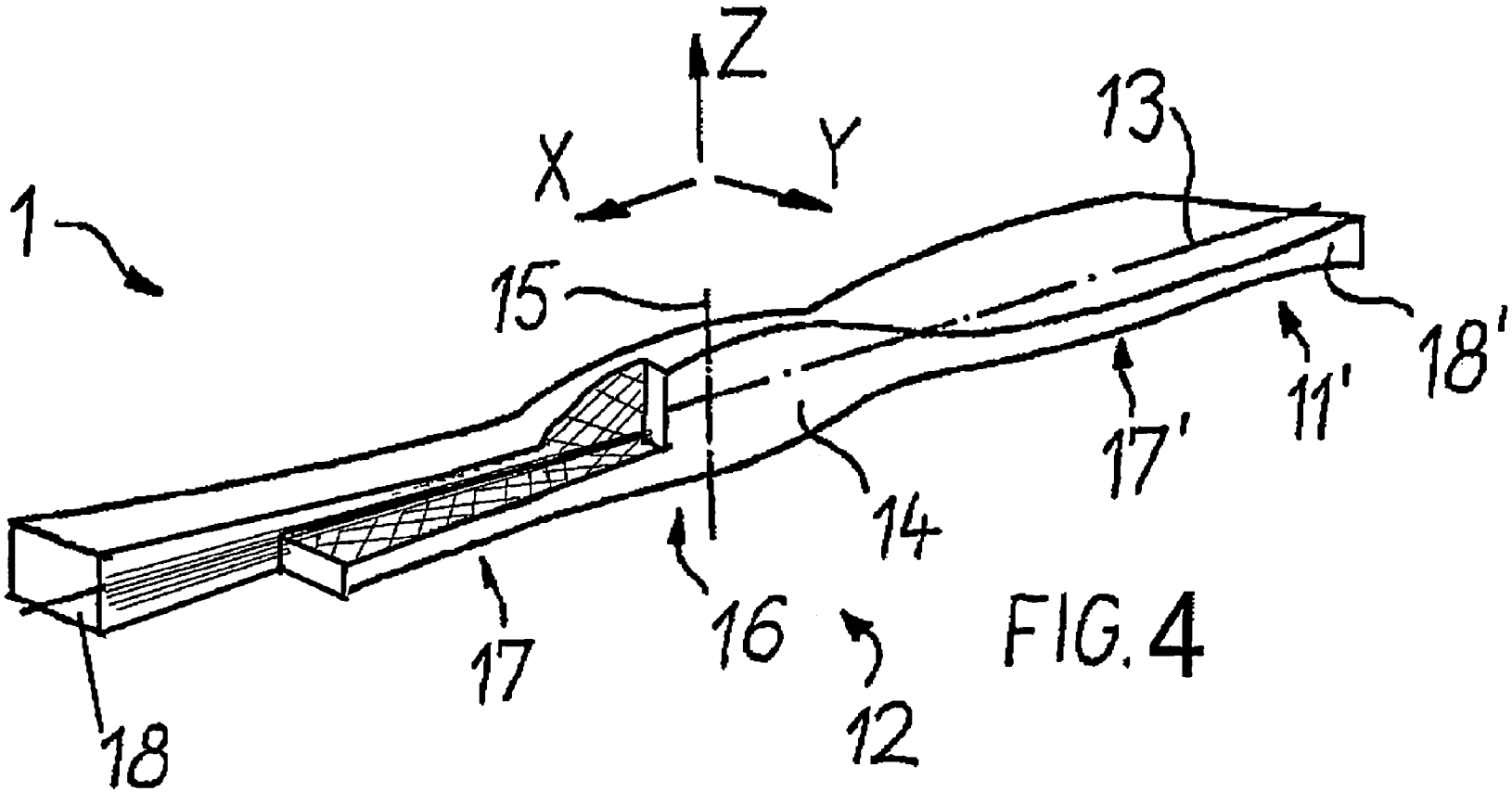
FIG. 4 cut-away perspective view of the wheelset guide of FIG. 2 indicating the fiber orentations.

As an alternative, according to FIG. 3, the end region 11 of the axle guide 1 can comprise two fixing lugs 19. This double lug connection is particularly well suited to taking transverse forces or lateral forces and the resulting moments of flexion.

What is claimed is:

1. A running gear for a rail vehicle comprising a wheel set, a frame and a wheelset guide made of a fiber-synthetic material composite, the wheelset guide comprising two end sections connecting the wheelset guide to the wheelset and to the frame of the running gear in a manner resistant to torsion, and a central section located in between said two end sections, the wheelset guide having a longitudinal axis approximately aligned with a direction of travel and a cross-section in a transverse direction that is at least partially flat in the vertical direction, wherein the central section of the wheelset guide comprises at least one integrated flexural joint with a vertical flexural axis.

2. The running gear according to claim 1, wherein the wheelset guide comprises at least one sub-section whose cross-sectional area tapers off towards the flexural joint.

3. The running gear according to claim 1, wherein the flexural joint is arranged between two sub-sections of the wheelset guide with cross-sections tapering off towards the flexural joint.

4. The running gear according to claim 1, wherein the cross-section of the wheelset guide in the region of the flexural joint has a thickness in the direction of the vertical flexural axis which is greater than its width in a horizontal transverse direction perpendicular to the longitudinal axis and the vertical flexural axis.

5. The running gear according to claim 1, wherein the cross-section of the wheelset guide, in the region of the flexural joint, is at least partly flat in a horizontal transverse direction.

6. The running gear according to claim 1, wherein a glass fiber synthetic material composite with fibers predominantly extending unidirectionally in the direction of the longitudinal axis is provided as a material for the wheelset guide.

7. The running gear according to claim 1, wherein the central section of the wheelset guide comprises shearing-action taking layers with fibers crossing each other at an angle of ±5° to ±60° in relation to the longitudinal axis.

8. The running gear according to claim 1, wherein the end sections of the wheelset guide predominantly comprise fibers extending unidirectionally in the direction of the longitudinal axis, and in that the central section predominantly comprises fibers crossing each other at an angle of ±5° to ±60° in relation to the longitudinal axis.

9. The running gear according to claim 1, wherein the vertical flexural rigidity of the wheelset guide is higher in the region of the flexural joint than it is in other wheelset guide regions.

10. The running gear according to claim 1, wherein a core of the wheelset guide comprises high-tensile R-glass fibers or S-glass fibers or high-strength or highly-rigid carbon fibers right through from one end section to the other end section.

11. The running gear according to claim 1, wherein the end sections of the wheelset guide comprise wedge-shaped thickened sections.

12. The running gear according to claim 1, wherein the end sections of the wheelset guide comprise fixing lugs.

13. A running gear for a rail vehicle comprising a wheel set, a frame and a wheelset guide made of a composite material for guiding the wheelset, the wheelset guide having a length in an x-axis direction, a width in a y-axis direction perpendicular to the x-axis, and a thickness in a z-axis direction perpendicular to the x-axis and y-axis, the wheelset guide comprising a central section, a first end section and a second end section arranged in the x-axis direction, the first and second end sections disposed adjacent to each end of the central section, wherein the central section comprises an integral flexural joint with a flexural axis in the z-axis direction, and the thickness of the first end section reduces in the x-axis direction toward the central section.

14. The running gear according to claim 13, wherein the thickness of the second end section of the wheelset guide reduces in the x-axis direction toward the central section.

15. The running gear according to claim 14, wherein the width of the first and second end sections of the wheelset guide reduce in the x-axis direction toward the central section.

16. The running gear according to claim 15, wherein the thickness of the wheelset guide is greater than its width in the region of the flexural joint.

17. The running gear according to claim 15, wherein the wheelset guide comprises a glass fiber synthetic material composite with fibers predominantly extending unidirectionally in the x-axis direction.

18. The running gear according to claim 15, wherein the central section of the wheelset guide comprises layers with fibers crossing each other at an angle of ±5° to ±60° in relation to the longitudinal axis.

* * * * *